US007971274B2

(12) United States Patent
Graneto, III

(10) Patent No.: US 7,971,274 B2
(45) Date of Patent: Jul. 5, 2011

(54) OVER THE HEAD, FULL COVERAGE DISPOSABLE MEDICAL GOWN

(75) Inventor: Joseph A. Graneto, III, Wildwood, MO (US)

(73) Assignee: Salus Corporation, St. Louis, MO (US)

( * ) Notice: Subject to any disclaimer, the term of this patent is extended or adjusted under 35 U.S.C. 154(b) by 94 days.

(21) Appl. No.: 12/552,769

(22) Filed: Sep. 2, 2009

(65) Prior Publication Data

US 2010/0299805 A1 Dec. 2, 2010

Related U.S. Application Data

(60) Provisional application No. 61/182,902, filed on Jun. 1, 2009.

(51) Int. Cl.
*A41D 13/12* (2006.01)

(52) U.S. Cl. ..... 2/114; 2/51; 2/52

(58) Field of Classification Search ..... 2/114, 51, 2/52, 48, 49.1, 84, 88, 46, 49.2–49.5, 50, 2/457, 456, 69, 69.5, 75, 80, 83, 85, 92, 87
See application file for complete search history.

(56) References Cited

U.S. PATENT DOCUMENTS

| | | | | | |
|---|---|---|---|---|---|
| D53,089 | S | | 3/1919 | Selsor | |
| D59,555 | S | | 11/1921 | Ladd | |
| 1,569,960 | A | * | 1/1926 | Geisler | 2/88 |
| 2,469,246 | A | | 5/1949 | Smicker | |
| 2,692,989 | A | * | 11/1954 | Jelstrup | 2/114 |
| 2,881,447 | A | * | 4/1959 | Shackelford | 2/49.1 |
| 3,146,464 | A | * | 9/1964 | Burnett | 2/49.3 |
| 3,230,546 | A | * | 1/1966 | Sabee | 2/114 |
| 3,399,406 | A | * | 9/1968 | Bradley | 2/114 |
| 3,451,062 | A | * | 6/1969 | Bradley | 2/114 |
| 3,736,597 | A | | 6/1973 | Artzt | |
| 3,824,625 | A | | 7/1974 | Green | |
| D236,293 | S | | 8/1975 | Banks | |
| 3,911,499 | A | | 10/1975 | Benevento et al. | |
| 4,000,521 | A | | 1/1977 | Zoephel et al. | |
| 4,017,909 | A | | 4/1977 | Brandiff | |
| 4,052,752 | A | | 10/1977 | Green | |
| 4,075,716 | A | | 2/1978 | Collins | |
| 4,408,357 | A | | 10/1983 | Toth | |
| 4,504,977 | A | | 3/1985 | King et al. | |
| 4,504,978 | A | | 3/1985 | Gregory, Jr. et al. | |
| 4,507,978 | A | | 4/1985 | Tanaka et al. | |
| 4,586,196 | A | | 5/1986 | White | |
| 4,608,719 | A | | 9/1986 | Lunt | |
| 4,819,275 | A | | 4/1989 | Lunt | |
| 4,829,602 | A | | 5/1989 | Harreld et al. | |
| 4,951,318 | A | * | 8/1990 | Harreld et al. | 2/48 |
| 5,036,547 | A | | 8/1991 | Silas | |
| D356,204 | S | | 3/1995 | Derrickson | |

(Continued)

*Primary Examiner* — Amy B Vanatta
(74) *Attorney, Agent, or Firm* — Armstrong Teasdale LLP

(57) ABSTRACT

A full coverage, over the head, disposable medical gown is described. The gown includes a front member, a left rear member, and a right rear member. The left rear member and the right rear member are folded over the front member to define a body portion of the gown. The left rear member and the right rear member are attached to one another to define a neck opening for the gown. This attachment occurs in an area that lies between the neck and the shoulder blades of a person wearing the gown. At least one of said left rear member and said right rear member includes perforations therein that extend from the neck opening to an edge of the respective rear member proximate the attachment area.

21 Claims, 6 Drawing Sheets

U.S. PATENT DOCUMENTS

| | | | | |
|---|---|---|---|---|
| 5,414,867 | A | 5/1995 | Bowling et al. | |
| 5,444,873 | A | 8/1995 | Levin | |
| 6,054,091 | A | 4/2000 | Miller et al. | |
| 6,070,268 | A * | 6/2000 | Holland | 2/49.1 |
| 6,378,136 | B2 | 4/2002 | Matsushita | |
| 6,851,125 | B2 * | 2/2005 | Fujikawa et al. | 2/51 |
| D533,982 | S | 12/2006 | Graneto, III | |
| 7,237,271 | B1 * | 7/2007 | McLandrich | 2/49.3 |
| D598,638 | S | 8/2009 | Graneto, III | |
| 2001/0032346 | A1 | 10/2001 | Matsushita et al. | |
| 2002/0095709 | A1 * | 7/2002 | Fujikawa et al. | 2/51 |
| 2006/0070166 | A1 * | 4/2006 | Matt et al. | 2/113 |
| 2006/0096003 | A1 * | 5/2006 | Plaatje et al. | 2/114 |
| 2007/0028343 | A1 * | 2/2007 | Makowka | 2/48 |
| 2009/0205098 | A1 * | 8/2009 | Araquistain | 2/50 |

* cited by examiner

OVER THE HEAD, FULL COVERAGE DISPOSABLE MEDICAL GOWN

CROSS-REFERENCE TO RELATED APPLICATIONS

This application claims the benefit of U.S. Provisional Patent Application Ser. No. 61/182,902, filed Jun. 1, 2009, the contents of which are incorporated by reference in their entirety.

BACKGROUND OF THE INVENTION

The field of the invention relates generally to infection control products, and more specifically, to a disposable medical gown that is generally utilized by health care professionals and visitors to certain hospital units.

Disposable medical gowns are known, but those known gowns have some drawbacks. For example, when removal of a gown from a person requires that a strap be untied, there is a chance that germs or viruses may be able to engage the clothing of the gown wearer based on a contact between the person's hand doing the untying and the clothing of the person wearing the gown. Disregarding the medical implications for a moment, such untying action may also expose the clothing to stains based on any medical compounds that are present on the hands, or more likely surgical gloves, of the person doing the untying.

Gowns that fully surround the body are the norm for certain patients, due to prior clothing removal. However, with a current awareness regarding infection control, there is a corresponding need that the medical professional, and any visitors to certain units within a medical facility, be completely surrounded to reduce the passing of germs, viruses, and other sources of infection from one person to another. However, such a full coverage gown should be easily operable, with minimal effort needed to put such a gown on or take it off, so as to limit contamination. As such there is still an unfilled need for a full coverage gown that can be put on by a user, and taken off by the user, in such a manner as to reduce the incidence of germs, viruses, and other sources of infection being passed from one person to another.

BRIEF DESCRIPTION OF THE INVENTION

In one aspect, a full coverage, over the head, disposable medical gown is provided that includes a front member, a left rear member, and a right rear member. The left rear member and the right rear member folded over the front member to define a body portion of the gown. The left rear member and the right rear member are attached to one another to define a neck opening for the gown, and the attachment occurs in an area that lies between the neck and the shoulder blades of a person wearing the gown. At least one of the left rear member and the right rear member includes perforations therein that extend from the neck opening to an edge of the respective rear member proximate the attachment area.

In another aspect, a medical gown is provided that includes a single piece body member having a first edge and a second edge, an attachment between a portion of the body member proximate the first edge and a portion of the body member proximate the second edge, and a plurality of perforations through the single piece body member in an area proximate the attachment. The body member is folded to form a front, a rear, and shoulders of the gown such that the first edge and the second edge are proximate one another to form the back of the gown and partially define a neck opening. The attachment is in an area that lies between the neck opening and the shoulder blades of a person wearing said gown and the perforations allow a user to easily rip the medical gown in the area of the perforations for removal of the medical gown from the user.

DETAILED DESCRIPTION OF THE INVENTION

The described embodiments are directed to a full coverage, over the head, disposable medical gown that includes a body portion and sleeves attached thereto. A neck opening is formed by attaching a small area of a left back member and a right back member of the body portion. Perforations in this area of attachment are useful in removal of the gown. A tie strap is attached to the front of the gown and may be tied behind or on one side of the wearer. The tie strap may also have perforations that are useful in removal of the gown as the various perforations form weak spots in the materials from which the gown is fabricated, allowing the wearer to easily tear the material in the perforation area to remove the gown.

Figure 1:
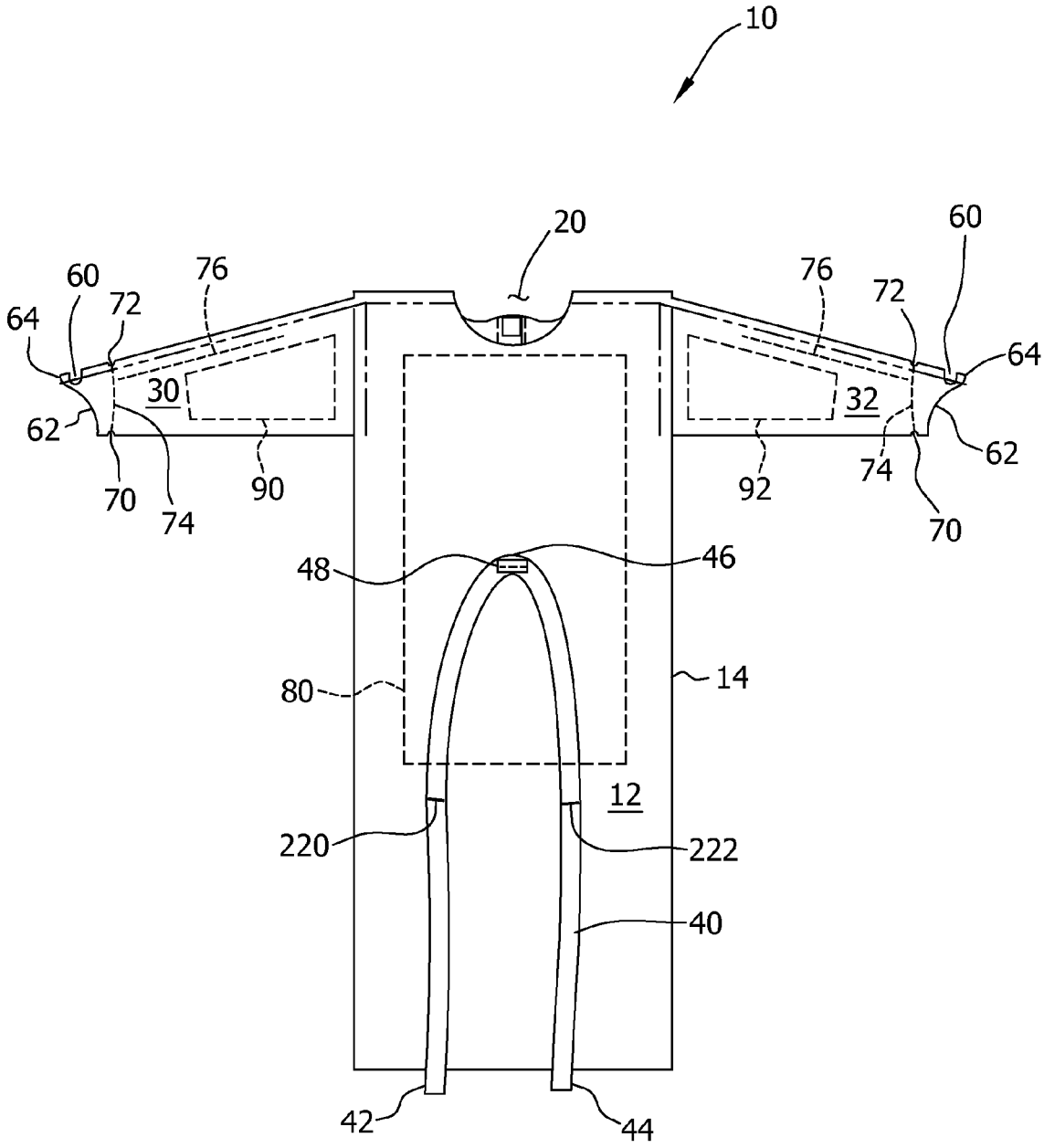
FIG. 1 is a front view of an over the head, full coverage, disposable medical gown.

Referring now to the figures, FIG. 1 is a front view of an over the head, full coverage, disposable medical gown 10. Gown 10, as illustrated, includes a body portion 12, a neck opening 20, sleeves 30 and 32 and a tie strap 40. Specifically, the portion of body portion 12 shown in FIG. 1 is generally meant to be worn across a front of a wearer's body and can be referred to as a front member 14. Ends 42 and 44, which are distant from a center section 46 of tie strap 40, are tied together across the back of the wearer as is easily understood. Tie strap 40 is of a length that will accommodate most, if not all, wearers of gown 10. The center section 46 is attached to body portion 12, at an appropriate position using a sealing process denoted by attached portion 48. In one embodiment, a heat sealing process is utilized. In alternative embodiments, the tie strap 40 may be attached using stitching or an adhesive. As described further herein, sleeves 30 and 32 may be attached to the body portion 12 using one or more of the heat sealing process, stitching and adhesive.

As explained above, gown 10 includes fully formed sleeves 30 and 32 through which the wearer inserts their respective arms and a neck opening 20 through which the wearer inserts their head. When properly worn, the shoulders, arms, torso and a portion of the wearer's legs are protected by gown 10. The neck opening 20 is generally a shallow U-shape when viewed from the front or back of gown 10. In various embodiments, sleeves 30 and 32 each include thumb holes 60 through which the wearer's thumb is inserted and hand holes 62 through which the four fingers are inserted. The openings 60 and 62 therefore define a strap 64 which engages the wearer's hand in the area between the thumb and fingers. Thumb holes 60, hand holes 62, and strap 64 give the sleeves 30 and 32 a glove-like quality and operate to prevent the sleeves 30 and 32 from creeping up the arm of the wearer. Such features not only operate to make the gown 10 more pleasant to wear, but help reduce the spreading of germs, viruses, and the like, by providing substantially complete arm coverage.

Notches 70 and 72 on sleeves 30 and 32 denote an optional elastic strip 74 that can be manufactured into gown 10 and are located in an area proximate the wearer's wrist when the gown 10 is properly worn. Another optional elastic strip 76 may be manufactured into the sleeves 30 and 32 along a length of the sleeves 30 and 32 to provide a gathering function for excess sleeve material, which is of benefit to wearer's of a certain size. In embodiments, the strips 74 and 76 are attached using one or more of the heat sealing process, stitching, and adhesive. One or more of elastic strips 74 and 76, when properly utilized, prevents the sleeves 30 and 32 from creeping up the arm or getting in the way of the wearer during use of the gown 10.

The front member 14 of gown 10 may also be manufactured to include an impervious pad 80 attached thereto which protects the wearer, at least to a certain extent, from fluids and liquids that may be present, or may become present in an infection control environment. Similar impervious pads 90 and 92 may be built into sleeves 30 and 32. Pads 80, 90, and 92 may be provided in various sizes and attached to gown 10 in various orientations. One or more of heat sealing, stitching, and an adhesive are utilized in attaching pads 80, 90, and 92 to gown 10. Upon completion of manufacturing, gown 10 is folded and placed into a fold over self contained pouch which is sized to be compatible with at least one known personal protection equipment organizer. In a specific embodiment, the overall size of the packaged gown 10 is about 5.75 inches by about 11.75 inches.

Figure 2:
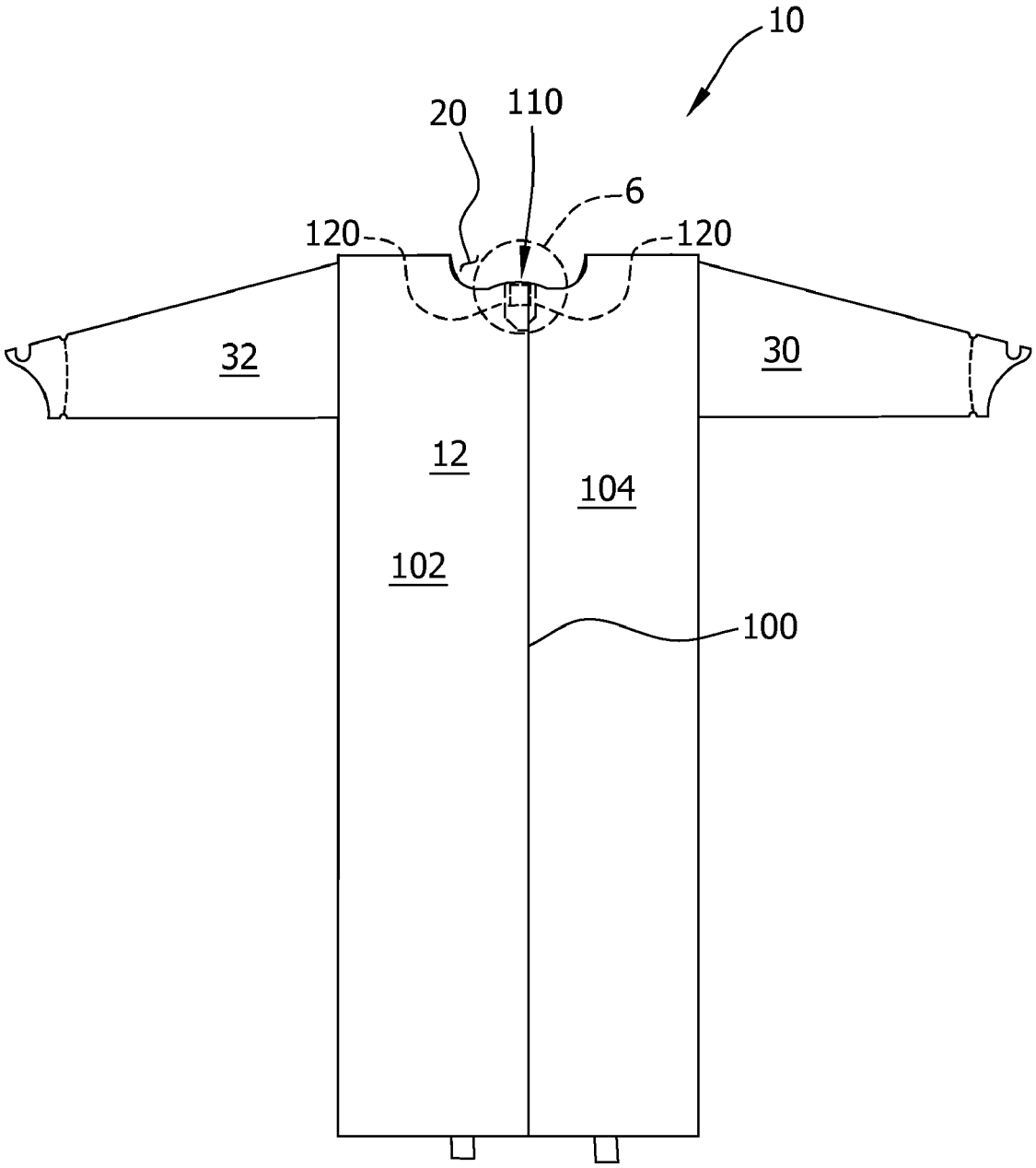
FIG. 2 is a rear view of the over the head, full coverage, disposable medical gown shown in FIG. 1.

Now referring to FIG. 2, a rear view of the over the head, full coverage, disposable medical gown 10 is shown. The line 100 denotes an overlap between a left rear member 102 and a right rear member 104 of the body portion 12. As will be explained with respect to subsequent figures, only a small portion of the left rear member 102 and right rear member 104 are attached to one another and this attachment occurs proximate the neck opening 20. In one embodiment, the attachment method utilized involves the stitching of the relevant portions of left rear member 102 and right rear member 104 to one another. In another embodiment, the sealing process mentioned above is utilized to attach the left rear member 102 and the right rear member 104 to one another. In another embodiment, a first portion of an adhesive strip (not shown) is non-removably attached to one of the left rear member 102 and right rear member 104 and a protective band is removed from a second portion of the adhesive strip, to expose an adhesive so that the second portion of the adhesive strip can be utilized to complete the attachment of the left rear member 102 and right rear member 104 to one another. Such an embodiment could be configured with an adhesive that allows for subsequent detachment of left rear member 102 and right rear member 104.

The area where left rear member 102 and right rear member 104 are attached to one another may be referred to as a perforation area 110 as both left rear member 102 and right rear member 104 have perforations 120 that extend through the material from which the gown is fabricated. Perforations 120 are useful in removal of the gown 10 as is also explained in subsequent paragraphs. In one embodiment, the length of the perforations 120 extend less than six inches from the neck opening 20. In a specific embodiment, the perforations 120 are about three inches in length, and allow a user to easily rip the material when removing the gown 10.

One embodiment of gown 10 is fabricated using polypropylene that has been coated with a polyethylene coating. Another embodiment utilizes spunbond meltblown spunbond (SMS) materials in the fabrication of gown 10.

Figure 3:
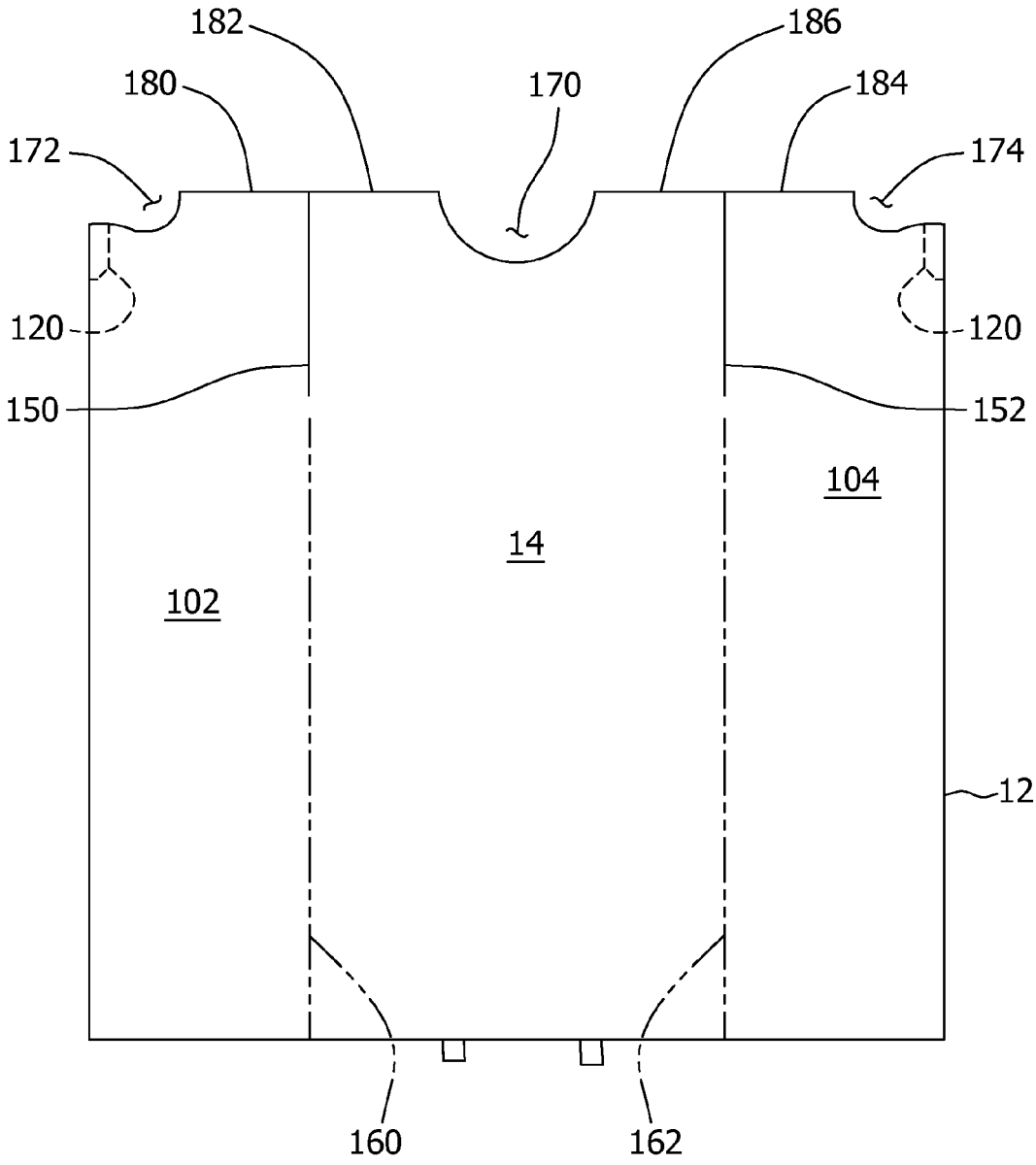
FIG. 3 is a material cut out view of a body portion of the disposable medical gown of FIG. 1 with the back portion of the gown yet to be folded.

FIG. 3 is a material cut out view of the body portion 12 of the disposable medical gown 10 providing a view of the front member 14, the left rear member 102 and the right rear member 104 of the gown 10. In such a configuration, the body portion 12 includes two cuts 150 and 152 formed therein which, after further processing, provide the opening in the gown 10 where the sleeves 30 and 32 will be attached. As shown, cuts 150 and 152 extend downward from a "top" of the body portion 12 for a distance. As shown, gown 10 has yet to be folded. Folding the material of the gown 10 along imaginary fold lines 160 and 162 (which in the illustrated embodiments are linear with cuts 150 and 152 respectively) is a portion of the process for forming the sleeve openings. As is easily understood, the left back member 102 is to be folded along fold line 160 and right back member 104 is to be folded along fold line 162.

The neck opening 20 shown in FIGS. 1 and 2 is formed, as shown in FIG. 3, by removal of portions of the front member 14, the left back member 102, and right back member 104 and these removed portions are denoted in FIG. 3, respectively, by reference numerals 170, 172, and 174 and referred to collectively as neck opening portions. In one embodiment, one or more of neck opening portions 170, 172, and 174, perforations 120, and cuts 150 and 152 are formed, for example, by a punching process when the material forming body portion 12 of gown 10 is laid out in the configuration shown in FIG. 3. For clarity, impervious pad 80 is not shown in FIG. 3 though it can be added before or after the processes described with respect to FIG. 3.

Once the punching process or other material removal process is completed, the body portion 12 of the gown is formed by attaching a top edge 180 of the left back member 102 to the left top edge 182 of the front member 14. Like wise, a top edge 184 of the right back member 104 is attached to a right top edge 186 of the front member. This attachment process forms the shoulder areas of the gown 10, and the cuts 150 and 152 become arm openings as a result. The sleeves 30 and 32 may then be attached to the arm openings. It should be noted that in certain manufacturing processes, it may be more efficient to attach the sleeves 30 and 32 to the body portion 12 before the top edges are attached to one another. Alternatively, the sleeves 30 and 32 may be formed and attached to the body portion 12 at the same time as the top edges are attached to one another. Again, either a sealing process or an adhesive may be used to attach the top edges 182 and 184, dependent at least on the material from which the gown 10 is fabricated. Similar processes may be utilized to attach sleeves 30 and 32 to body portion 12.

Figure 4:
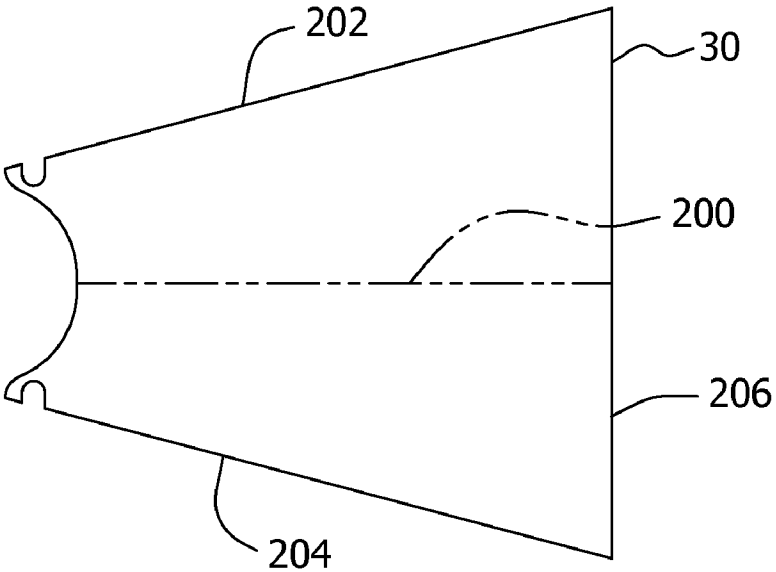
FIG. 4 is a material cut out view of a sleeve to be attached to the body portion shown in FIG. 3.

FIG. 4 is a material cut out view of sleeve 30, though it should be understood that embodiments described herein with respect to sleeve 30 are equally applicable to sleeve 32. In addition to the components introduced with respect to FIG. 1, sleeve 30 also includes an imaginary fold line 200. By folding sleeve along fold line 200, edges 202 and 204 come into contact with one another as do the mating portions of sleeve 30 that form thumb hole 60, hand opening 62, and strap 64. Edges 202 and 204 are attached to one another to form sleeve 30 and its herein described components. In the illustrated embodiment, attachment of edges 202 and 204 form a top of the sleeve, though the disclosure should not be construed to be so limited. The sealing process mentioned elsewhere herein may be utilized to attach edges 202 and 204 and thus form sleeve 30. In alternative embodiments an adhesive may be utilized to attach edges 202 and 204. Sleeves 30 and 32 are eventually attached to body portion 12 in one of the manners described above. For clarity, elastic strips 74 and 76 are not shown in FIG. 4. For clarity, impervious pads 90 and 92 are not shown in FIG. 4. However, elastic strips 74 and 76 and impervious pads 90 and 92 may be added before or after the processes described with respect to FIG. 4.

Figure 5:
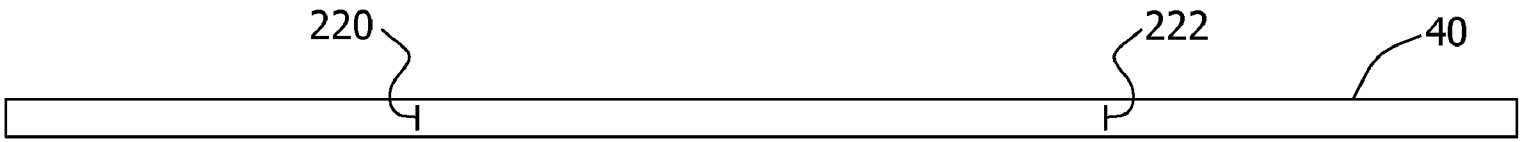
FIG. 5 is a material cut out view of a tie strap to be attached to the body portion shown in FIG. 3.

FIG. 5 is a material cut out view of tie strap 40. Strap 40 is eventually attached to the front member 14 of gown 10 as described above. Strap 40 includes two perforations 220, 222 formed therein which allow for a wearer to easily break the strap 40 when attempting to remove the gown 10, as illustrated in FIG. 7.

Figure 6:
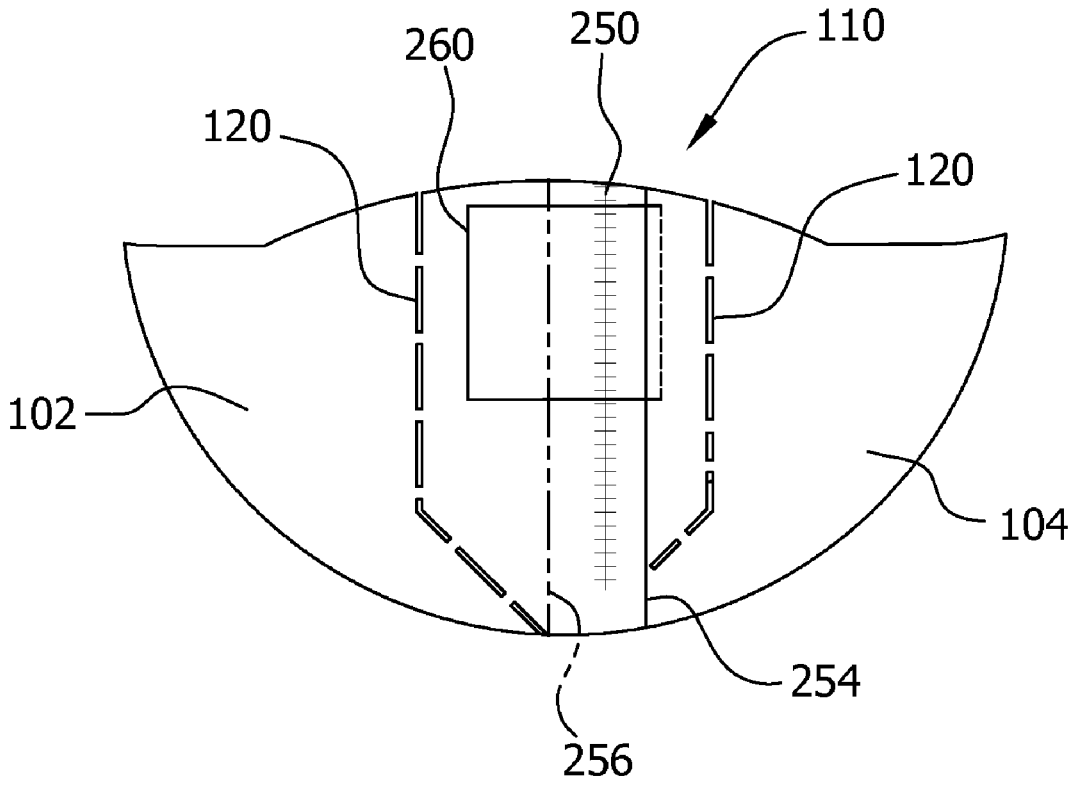
FIG. 6 is a detailed view of the neck area disposable medical gown illustrating attachment between back members and perforations in the gown material.

FIG. 6 is a detailed view of perforation area 110 which better illustrates the perforations that are formed in both the left rear member 102 and right rear member 104. It is within this area 110, in one embodiment, where the left rear member 102 and the right rear member 104 are attached to one another to complete the neck opening 20 (shown in FIGS. 1 and 2). In the illustrated embodiment, the attachment is formed through the utilization of stitches 250 that extend through both the left rear member 102 and right rear member 104 proximate their respective edges 254 and 256. The stitches may extend through a manufacturer's label 260 to maintain its position. In alternative embodiments, the left rear member 102 and right rear member 104 may be attached to one another using one or more of a sealing process or an adhesive. In other embodiments, the label 260 is pre-attached to the material from which gown 10 is fabricated and the perforations 120 may go through the label 260, though this embodiment is not shown in FIG. 6. In still another embodiment, the label 260 may be fabricated in such a way that it performs both the function of attaching the left rear member 102 to the right rear member 104 and providing the weak point (such as perforations 120) for the removal of the gown 10 from the wearer. As mentioned previously, the perforations 120 extend for a relatively short length, as compared to the overall length of gown 10, which translates into a relatively easy removal of the gown 10 by only having to tear the material in the location of the perforations 120.

As described herein, gown 10 includes perforations 120 proximate the neck opening 20 and perforations 220 and 222 in the tie strap 40. Other configurations for perforations are considered, as long as they provide the utility which is illustrated in FIG. 7, which is a depiction of a wearer 300 removing gown 10. As shown, to remove gown 10, the wearer 300 grabs a portion of the front member 14 and pulls away from their body. The perforations 120, 220, and 222, allow the wearer to easily remove the gown 10 by pulling on the front member 14 of the gown 10. The perforations 120, 220, and 222 form a weak point in the material from which the gown 10 is fabricated and therefore the tie straps 40 will break at one or both of perforations 220 and 222 and the perforations 120 will also cause a breakage proximate the neck opening 20, where the left rear member 102 and right rear member 104 are attached to one another. The length of the interconnection between left rear member 102 and right rear member 104 is important as that length is substantially the same length as a length of the several individual perforations that make up perforations 120, allowing for a relatively easy separation of left rear member 102 and right rear member 104 by the wearer.

Figure 7:
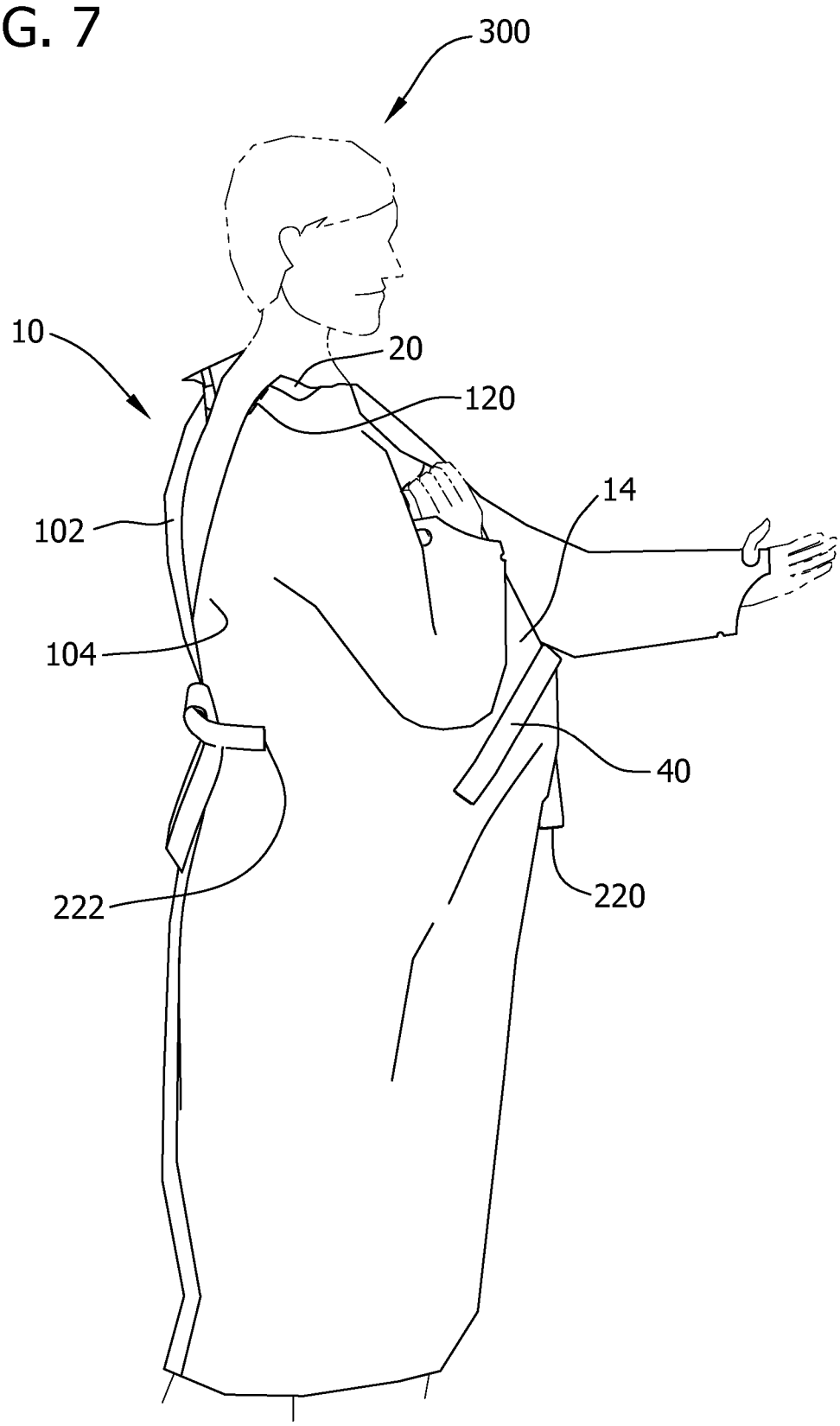
FIG. 7 is a depiction illustrating the removal of the over the head, full coverage, disposable medical gown described by FIGS. 1-6.

Both breakage of the tie strap 40 and breakage proximate neck opening 20 (possible through the implementation of perforations 120, 220, and 222) are shown in the depiction of FIG. 7. In the various figures, the perforations 120, 220, and 22, are shown as simple slits in the material from which the gown is fabricated. However, in alternative embodiments, the various perforations can take the form of individual ovals or other geometric figures that have been cut out of the material, simplifying removal of the gown 10 from the wearer 300. Specifically, when the wearer wishes to remove the gown 10, they simply pull on the front member 14 of the body portion 12, and the weaknesses in the material due to the various perforations results in a tearing of the material along one or both of the lines of perforations 120 proximate the neck opening, as well as one or both of perforations 220 and 222, allowing for removal of the gown 10 in a matter that is helpful in reducing the spread of germs, viruses and the like.

The above described embodiments improve on the prior art by addressing the shortcomings associated with gown removal and resistance to material tearing during use. A full coverage, over the head, disposable medical gown is described herein that includes a body portion and sleeves attached thereto. A neck opening is formed by attaching a small area of a left back member and a right back member of the body portion. Perforations proximate this attachment area are useful in removal of the gown. The tie strap attached to the front of the gown may be tied behind or on one side of the wearer. The tie strap may also have perforations that are useful in removal of the gown as the various perforations form weak spots in the materials from which the gown is fabricated allowing the wearer to easily tear the material in removal of the gown.

As such, this written description uses examples to disclose the invention, including the best mode, and also to enable any person skilled in the art to practice the invention, including making and using any devices or systems and performing any incorporated methods. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A full coverage, over the head, disposable medical gown, comprising:

a front member having a first length associated therewith;

a left rear member; and a right rear member, said left rear member and said right rear member folded behind said front member to define a body portion of said gown, said left rear member and said right rear member having a length substantially equal to said front member to provide the full coverage, said left rear member and said right rear member attached to one another to define a neck opening for said gown, the attachment occurring only within an area that lies generally between the neck and the shoulder blades of a person wearing said gown, at least one of said left rear member and said right rear member comprising perforations therein, said perforations extending from the neck opening to a side edge of the respective rear member proximate the attachment between said left rear member and said right rear member.

2. A full coverage, over the head, disposable medical gown according to claim 1 wherein the attachment between said left rear member and said right rear member is made using at least one of a stitching process, a sealing process, and an adhesive process.

3. A full coverage, over the head, disposable medical gown according to claim 1 wherein said front member, said left rear member, and said right rear member each comprise a top edge, attachment of said left rear member top edge to said front member top edge defining a first shoulder for said gown and a portion of the neck opening for said gown, attachment of said right rear member top edge to said front member top edge defining a second shoulder for said gown and a portion of the neck opening for said gown.

4. A full coverage, over the head, disposable medical gown according to claim 1 wherein said front member; said left rear member, and said right rear member are formed from a single piece of material, a partial cut through the material along a fold line between said front member and said left rear member defining a first arm opening upon folding of said left rear member over said front member, a partial cut through the material along a fold line between said front member and said right rear member defining a second arm opening, upon folding of said right rear member over said front member.

5. A full coverage, over the head, disposable medical gown according to claim 4 further comprising sleeves attached to said gown about the first arm opening and the second arm opening.

6. A full coverage, over the head, disposable medical gown according to claim 5 wherein said sleeves comprise an elastic strip attached thereto, said elastic strip positioned along a length of said sleeves to provide a gathering function for excess sleeve material when said gown is worn by a user.

7. A full coverage, over the head, disposable medical gown according to claim 5 wherein said sleeves each comprise thumb holes and hand holes therein defining a strap which engages the hand of a user in the area between their thumb and fingers.

8. A full coverage, over the head, disposable medical gown according to claim 5 wherein said sleeves each comprise an impervious pad attached thereto, said impervious pads positioned within said sleeves to counteract, to a certain extent, fluids and liquids that may be encountered in a user environment.

9. A full coverage, over the head, disposable medical gown according to claim 1 wherein said front member comprises an impervious pad attached thereto, said impervious pad positioned to counteract, to a certain extent, fluids and liquids that may be encountered in a user environment.

10. A full coverage, over the head, disposable medical gown according to claim 1 wherein said front member, said left rear member, and said right rear member comprise at least one of polypropylene that has been coated with a polyethylene coating and spunbond meltblown spunbond (SMS) material.

11. A full coverage, over the head, disposable medical gown according to claim 1 further comprising a tie strap attached to said front member, said tie strap for tying about the waist of a user, said tie strap further comprising at least one perforation therethrough operable for easily breaking said tie strap when removing said gown.

12. A medical gown, comprising:

a single piece body member comprising a first edge and a second edge, said body member folded to form a front, a rear, and shoulders of said gown such that said first edge and said second edge are proximate one another to form the back of said gown and partially define a neck opening, the front and the rear having a substantially equal length;

an attachment between a portion of said body member proximate said first edge and a portion of said body member proximate said second edge, the attachment limited to an area that lies between the neck opening and the shoulder blades of a person wearing said gown; and a plurality of perforations through said single piece body member contained within an area proximate said attachment and extending from the neck opening to one of the first edge and the second edge, said perforations allowing a user to easily rip said medical gown in the area of said perforations for removal of said medical gown from the user.

13. A medical gown according to claim 12 wherein said attachment comprises at least one of stitching, a seal, and an adhesive between said body member proximate said first edge and said body member proximate said second edge.

14. A medical gown according to claim 12 wherein said body member proximate said first edge comprises a first portion of a manufacturers label attached thereto, said attachment comprising a second portion of said manufacturers label attached to said body member proximate said second edge.

15. A medical gown according to claim 14 wherein at least a portion of said perforations extend through said manufacturers label.

16. A medical gown according to claim 12 further comprising a cut in said body member proximate each fold and each shoulder, said cuts operable as arm openings.

17. A medical gown according to claim 16 further comprising a plurality of sleeves attached to said body member about perimeters defined by said cuts and each shoulder.

18. A medical gown according to claim 17 wherein at least one of said sleeves comprise an elastic strip attached thereto, said elastic strip positioned along a length of said sleeve to provide a gathering function for excess sleeve material.

19. A medical gown according to claim 17 wherein at least one of said sleeves comprise an impervious pad attached thereto.

20. A medical gown according to claim 12 wherein said body member comprises an impervious pad attached thereto, said impervious pad located on said body member such that it is proximate a front of the user.

21. A medical gown according to claim 12 further comprising a tie strap attached to said body member, said tie strap for tying about the waist of a user, said tie strap further comprising at least one perforation therethrough operable for easily breaking said tie strap when removing said gown.

* * * * *